US009216431B2

(12) United States Patent
Perelli

(10) Patent No.: US 9,216,431 B2
(45) Date of Patent: Dec. 22, 2015

(54) SATELLITE SPRAY BOTTLE USE AND REFILL SYSTEMS

(71) Applicant: L&F Innoventions, LLC, Naples, FL (US)

(72) Inventor: Thomas Perelli, Raleigh, NC (US)

(73) Assignee: L&F Innoventions, LLC, Naples, FL (US)

( * ) Notice: Subject to any disclaimer, the term of this patent is extended or adjusted under 35 U.S.C. 154(b) by 247 days.

(21) Appl. No.: 13/925,287

(22) Filed: Jun. 24, 2013

(65) Prior Publication Data

US 2013/0340886 A1 Dec. 26, 2013

Related U.S. Application Data

(60) Provisional application No. 61/663,051, filed on Jun. 22, 2012.

(51) Int. Cl.

| | |
|---|---|
| ***B05B 11/00*** | (2006.01) |
| ***B67D 7/02*** | (2010.01) |
| ***B65D 81/22*** | (2006.01) |
| ***B65D 1/40*** | (2006.01) |
| ***B65D 90/02*** | (2006.01) |
| ***B65D 1/06*** | (2006.01) |
| ***B05B 15/06*** | (2006.01) |

(Continued)

(52) U.S. Cl.

CPC ..... *B05B 11/0097* (2013.01); *A47L 13/22* (2013.01); *B05B 11/0037* (2013.01); *B05B 11/0056* (2013.01); *B05B 11/3057* (2013.01); *B05B 15/061* (2013.01); *B05B 15/065* (2013.01); *B65D 1/06* (2013.01); *B65D 1/40* (2013.01); *B65D 81/22* (2013.01); *B65D 90/027* (2013.01); *B67D 7/0288* (2013.01); *B05B 15/005* (2013.01)

(58) Field of Classification Search

CPC .. B05B 11/0097; B05B 11/0056; B65B 3/04; B67D 1/124

USPC ..... 141/18, 103–104, 113, 248, 234, 141/319–320, 330, 351, 375, 346; 222/505; 220/23.4

See application file for complete search history.

(56) References Cited

U.S. PATENT DOCUMENTS

| | | | |
|---|---|---|---|
| 3,926,341 | A | 12/1975 | Lhoest |
| 4,035,004 | A | 7/1977 | Hengesbach |

(Continued)

OTHER PUBLICATIONS

Non-final Office Action mailed Jun. 26, 2013 for U.S. Appl. No. 12/895,982.

*Primary Examiner* — Timothy L Maust
*Assistant Examiner* — Timothy P Kelly
(74) *Attorney, Agent, or Firm* — NK Patent Law, PLLC

(57) ABSTRACT

A satellite spray bottle use and refill system includes a spray bottle and a refill station. The spray bottle includes a container housing that defines an internal reservoir space, a spray head connected to an upper margin of the container housing, a mounting structure connected to the container housing, and a refill inlet in fluid connection with the internal reservoir space. The refill station has a support structure for supporting the mounting structure of the spray bottle, and a discharge outlet for refilling the internal reservoir space of the spray bottle. Upon engagement of the mounting structure of the spray bottle with the support structure of the refill station, the refill inlet of the spray bottle and the discharge outlet of the refill station are automatically docked establishing a fluid connection. In some cases, the refill station is vertically invertible.

14 Claims, 4 Drawing Sheets

(51) Int. Cl.
*A47L 13/22* (2006.01)
*B05B 15/00* (2006.01)

(56) References Cited

U.S. PATENT DOCUMENTS

| | | | | |
|---|---|---|---|---|
| 4,256,154 | A | 3/1981 | Black | |
| 4,558,821 | A | 12/1985 | Tada et al. | |
| 4,618,076 | A | 10/1986 | Silvenis | |
| 4,705,191 | A | 11/1987 | Itzel et al. | |
| 4,781,311 | A | 11/1988 | Dunning et al. | |
| 4,830,235 | A | 5/1989 | Miller | |
| 4,925,066 | A | 5/1990 | Rosenbaum | |
| 5,031,798 | A | 7/1991 | Wild | |
| 5,056,685 | A | 10/1991 | Wild | |
| 5,083,678 | A | 1/1992 | Waring | |
| 5,152,431 | A | 10/1992 | Gardner et al. | |
| 5,156,295 | A | 10/1992 | Gordon et al. | |
| 5,156,299 | A | 10/1992 | De Caluwe et al. | |
| 5,160,071 | A | 11/1992 | Wright | |
| 5,174,458 | A | 12/1992 | Segati | |
| 5,195,664 | A | 3/1993 | Rhea | |
| 5,244,125 | A | 9/1993 | Robbins, III | |
| 5,251,820 | A | 10/1993 | Ho | |
| 5,328,055 | A | 7/1994 | Battle | |
| 5,337,921 | A | 8/1994 | Wilson et al. | |
| 5,398,846 | A | 3/1995 | Corba et al. | |
| 5,421,485 | A | 6/1995 | Furuta et al. | |
| 5,429,254 | A | 7/1995 | Christine | |
| 5,439,141 | A | 8/1995 | Clark et al. | |
| 5,472,119 | A | 12/1995 | Park et al. | |
| 5,474,212 | A | 12/1995 | Ichikawa et al. | |
| 5,478,015 | A | 12/1995 | Black | |
| 5,542,581 | A | 8/1996 | Habora et al. | |
| 5,558,257 | A | 9/1996 | Braun | |
| 5,718,383 | A | 2/1998 | Smith et al. | |
| 5,832,972 | A * | 11/1998 | Thomas et al. | 141/360 |
| 5,836,479 | A | 11/1998 | Klima et al. | |
| 5,839,616 | A | 11/1998 | Irwin et al. | |
| 5,871,122 | A | 2/1999 | Klima et al. | |
| 5,890,624 | A | 4/1999 | Klima et al. | |
| 5,934,519 | A | 8/1999 | Kim et al. | |
| 5,944,223 | A | 8/1999 | Klima et al. | |
| 5,947,332 | A | 9/1999 | Klima, Jr. et al. | |
| 5,979,715 | A | 11/1999 | Emrick | |
| 5,984,199 | A | 11/1999 | Restive | |
| 6,027,041 | A | 2/2000 | Evans | |
| 6,059,152 | A | 5/2000 | Mayfield | |
| 6,123,230 | A | 9/2000 | Klima, Jr. et al. | |
| 6,179,142 | B1 | 1/2001 | Hansen | |
| 6,206,243 | B1 | 3/2001 | Schneider et al. | |
| 6,213,358 | B1 | 4/2001 | Libit et al. | |
| 6,250,511 | B1 | 6/2001 | Kelly | |
| 6,253,993 | B1 | 7/2001 | Lloyd et al. | |
| 6,319,453 | B1 | 11/2001 | Klima, Jr. et al. | |
| 6,345,774 | B1 | 2/2002 | Calhoun | |
| 6,394,319 | B1 | 5/2002 | Pucillo | |
| 6,409,103 | B1 | 6/2002 | Norville et al. | |
| 6,530,108 | B1 | 3/2003 | Brown et al. | |
| 6,540,109 | B1 | 4/2003 | Klima et al. | |
| 6,631,830 | B2 | 10/2003 | Ma et al. | |
| 6,659,670 | B1 | 12/2003 | Blouse | |
| 6,732,958 | B2 | 5/2004 | Norville et al. | |
| 6,789,303 | B2 | 9/2004 | Maas et al. | |
| 6,833,072 | B1 | 12/2004 | Krestine et al. | |
| 6,834,815 | B2 | 12/2004 | Appleby | |
| 7,040,510 | B1 | 5/2006 | Hester | |
| 7,251,839 | B2 | 8/2007 | Bell | |
| 7,478,738 | B2 | 1/2009 | Hood et al. | |
| 7,520,447 | B2 | 4/2009 | Engelen et al. | |
| 7,581,273 | B2 | 9/2009 | Dobrin et al. | |
| 7,648,083 | B2 | 1/2010 | Hornsby et al. | |
| 7,717,306 | B2 | 5/2010 | White, Sr. | |
| 7,926,682 | B2 * | 4/2011 | Nelson et al. | 222/130 |
| 8,079,388 | B2 * | 12/2011 | Turgeman | 141/113 |
| 8,157,131 | B2 | 4/2012 | Sim | |
| 2001/0011661 | A1 | 8/2001 | Klima et al. | |
| 2001/0022204 | A1 * | 9/2001 | Klima et al. | 141/103 |
| 2002/0031625 | A1 | 3/2002 | Klima, Jr. et al. | |
| 2003/0038186 | A1 | 2/2003 | Klima et al. | |
| 2004/0035819 | A1 | 2/2004 | Dennison | |
| 2004/0104194 | A1 | 6/2004 | Dennison | |
| 2004/0245208 | A1 | 12/2004 | Dennison | |
| 2005/0167442 | A1 | 8/2005 | Cuisinier | |
| 2006/0143847 | A1 | 7/2006 | Vinson et al. | |
| 2006/0237485 | A1 | 10/2006 | An | |
| 2007/0215645 | A1 | 9/2007 | Clynes et al. | |
| 2007/0235472 | A1 | 10/2007 | McFarland | |
| 2008/0011779 | A1 | 1/2008 | Klima et al. | |
| 2008/0279611 | A1 | 11/2008 | Graphenious | |
| 2008/0315018 | A1 | 12/2008 | Withers | |
| 2009/0212077 | A1 | 8/2009 | Carden | |
| 2009/0277928 | A1 | 11/2009 | Bruckner | |
| 2010/0096414 | A1 | 4/2010 | Dennis | |
| 2010/0096415 | A1 | 4/2010 | Dennis | |
| 2011/0062185 | A1 | 3/2011 | McFarland | |
| 2011/0121039 | A1 | 5/2011 | Dennis | |
| 2011/0158740 | A1 | 6/2011 | Kandasamy et al. | |
| 2011/0180101 | A1 | 7/2011 | Konishi et al. | |
| 2011/0180619 | A1 | 7/2011 | Konishi et al. | |

* cited by examiner

SATELLITE SPRAY BOTTLE USE AND REFILL SYSTEMS

TECHNICAL FIELD

The present disclosure relates to satellite spray bottle use and refill systems.

BACKGROUND

Refilling of spray bottles is a time intensive and cumbersome process. Products and methods have been introduced to alleviate the disadvantages associated with refilling of spray bottles, however, those products and methods have not been satisfactory.

SUMMARY

This Summary is provided to introduce a selection of concepts in a simplified form that are further described below in the Detailed Descriptions. This Summary is not intended to identify key features or essential features of the claimed subject matter, nor is it to be construed as limiting the scope of the claimed subject matter.

According to at least one embodiment, a satellite spray bottle use and refill system includes a spray bottle and a refill station. The spray bottle includes a container housing that defines an internal reservoir space, a spray head connected to an upper margin of the container housing, a mounting structure connected to the container housing, and a refill inlet in fluid connection with the internal reservoir space. The refill station has a support structure for supporting the mounting structure of the spray bottle, and a discharge outlet for refilling the internal reservoir space of the spray bottle. Upon engagement of the mounting structure of the spray bottle with the support structure of the refill station, the refill inlet of the spray bottle and the discharge outlet of the refill station are automatically docked establishing a fluid connection.

In at least one example the mounting structure of the spray bottle includes a mounting foot extending horizontally from a lower margin of the container housing. The refill inlet of the spray bottle may be positioned on the mounting foot.

In at least one example, the refill station includes a refill tank, and the support structure of the refill station includes material edges of the refill tank, the material edges defining a slot of the refill tank. The slot receives the mounting foot of the spray bottle when the spray bottle is engaged with the refill station. The discharge outlet of the refill station may be positioned in the slot, which may be positioned along a lower floor of the refill tank.

In at least one example, the refill station includes a pair of cartons in vertically stacked and inverted relation to each other. In at least one such example, the refill station includes a pair of conduit fixtures, one vertically arranged over the other, each carton includes a spout, the spout of an upper one of the pair of cartons is docked with an upper one of the conduit fixtures, and the spout of a lower one of the pair of cartons is docked with a lower one of the conduit fixtures. The refill inlet of the spray bottle may be docked with the upper conduit fixture, which may define the discharge outlet, upon engagement of the mounting structure of the spray bottle with the support structure of the refill station. The support structure of the refill station may include a terminal ledge that extends horizontally from a lower margin of the refill station.

According to at least one other embodiment, a satellite spray bottle use and refill system includes a spray bottle and a vertically invertible dual refill station. The spray bottle includes a container housing that defines an internal reservoir space, a spray head connected to an upper margin of the container housing, a mounting structure connected to the container housing, and a refill inlet in fluid connection with the internal reservoir space. The vertically invertible refill station has at least one support structure for supporting the mounting structure of the spray bottle, and at least a first conduit fixture and a second conduit fixture for refilling of the spray bottle. In a first orientation of the refill station, the refill inlet of the spray bottle and the first conduit fixture of the refill station are automatically docked establishing a fluid connection upon engagement of the mounting structure of the spray bottle with at least one support structure of the refill station. In a second orientation of the refill station vertically inverted relative to the first orientation, the refill inlet of the spray bottle and the second conduit fixture of the refill station are automatically docked establishing a fluid connection upon engagement of the mounting structure of the spray bottle with at least one support structure of the refill station.

In at least one example, in both the first and second orientation of the refill station, the spray bottle is dockable to the refill station through a horizontal approach and is dismountable from the refill station through a horizontal departure.

In at least one example, the refill station includes a housing defining an interior space, and at least a first carton and a second carton placed in the interior space in vertically stacked and inverted relation to each other. In both the first and second orientation of the refill station, a fluid connection between the refill inlet of the spray bottle and the upper one of the first and second cartons is automatically established upon engagement of the mounting structure of the spray bottle with at least one support structure of the refill station.

In at least one example, the first and second conduit fixtures are attached to the housing, the first carton includes a spout connected to the first conduit fixture, and the second carton includes a spout connected to the second conduit fixture. The first and second conduit fixtures may be vertically arranged one over the other.

In at least one example, each carton includes at least one flexible rectangular flap having at least one hole that receives a pin that extends from the housing. The housing may include two essentially identical blanks, each including planar wall portions connected together by flexure zones.

In at least one example, each blank includes a rectangular panel and a strap extending from the rectangular panel such that two straps wrap at least partially around the housing in the same circumferential direction, with the strap of each blank engaging the rectangular panel of the other blank.

In at least one example, a lower terminal ledge and an upper terminal ledge extend horizontally from the refill station to, respectively, support the spray bottle from below and engage the spray head from above.

BRIEF DESCRIPTION OF THE DRAWINGS

The foregoing summary, as well as the following detailed description of preferred embodiments, is better understood when read in conjunction with the appended drawings. For the purposes of illustration, there is shown in the drawings exemplary embodiments; however, the presently disclosed invention is not limited to the specific methods and instrumentalities disclosed.

DETAILED DESCRIPTIONS

While the disclosure of the technology herein is presented with sufficient details to enable one skilled in this art to practice the invention, it is not intended to limit the scope of the disclosed technology. The inventor(s) contemplate that future technologies may facilitate additional embodiments of the presently disclosed subject matter as claimed herein. Moreover, although the term "step" may be used herein to connote different aspects of methods employed, the term should not be interpreted as implying any particular order among or between various steps herein disclosed unless and except when the order of individual steps is explicitly described.

Figure 1A:
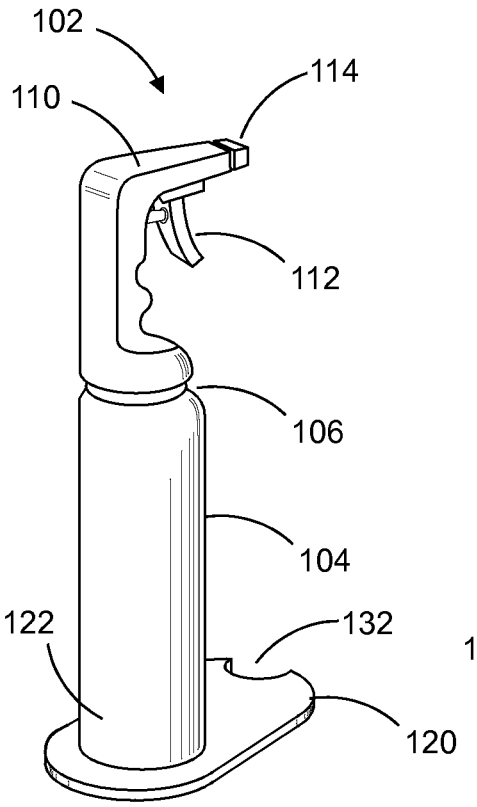
FIGS. 1A, 1B, and 1C are perspective views of a bottle and refill station according to one embodiment disclosed herein.
Figure 1B:
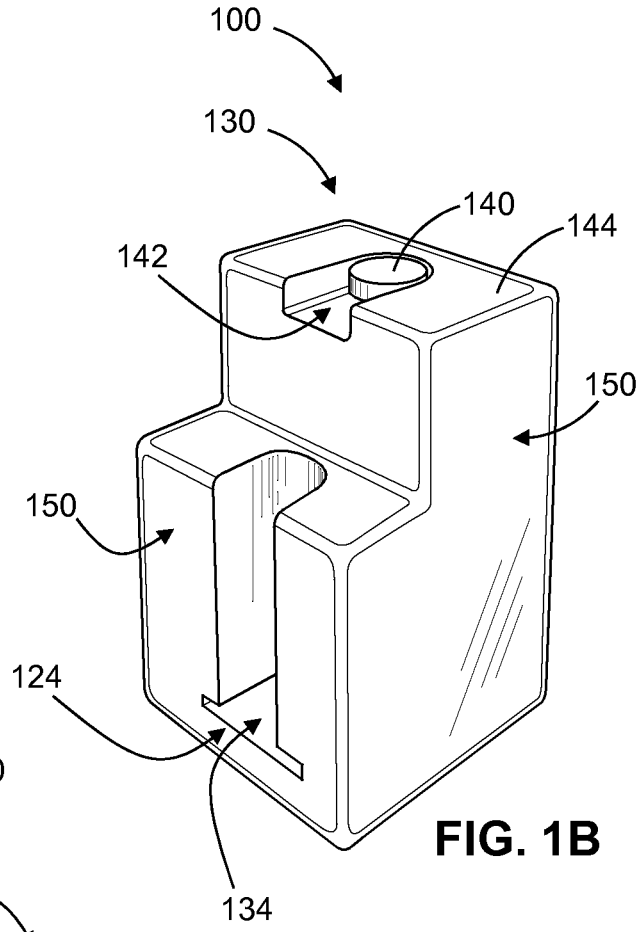
Figure 1C:
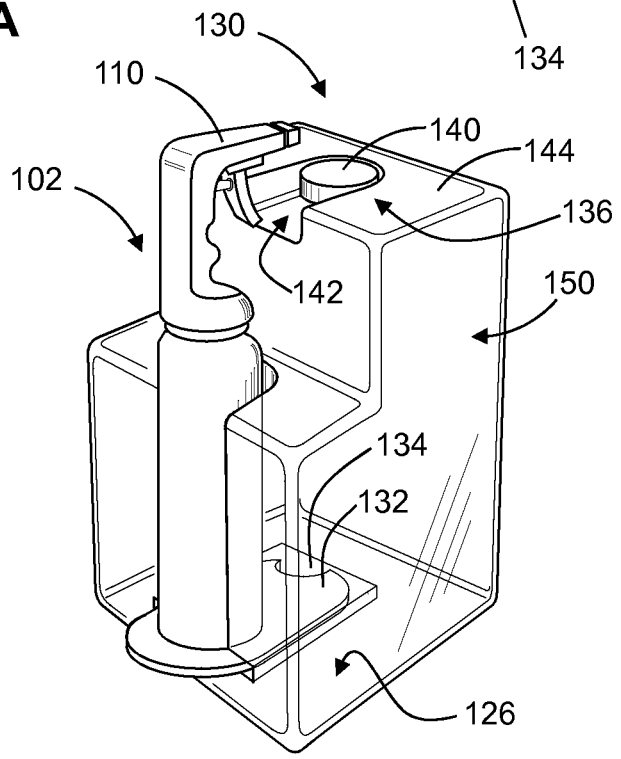

A spray bottle use and refill satellite system 100 according to at least one embodiment is illustrated in FIGS. 1A-1C. A spray bottle 102 includes a container housing 104 that defines an internal reservoir space, a neck 106 connected to the upper margin of the housing 104, and a spray head 110 mounted to the top of the neck 106. The spray head 110 includes an operable trigger 112 that actuates an internal pumping mechanism which draws liquid from the container housing 104 through a straw or other internal fluid conduit and causes dispensation of the drawn liquid through a nozzle 114 of the hand-held spray head. The container housing 104 in at least one embodiment can be refilled by removing the hand-held spray head 110 from the neck 106 and the filling the internal reservoir space through the neck. The hand-held spray head 110 may be mounted to the neck 106, for example, by a snap closure, threaded collar, or other releasable sealing structure.

The spray bottle 102 of FIGS. 1A-1C has a mounting foot 120 illustrated as projecting forward from the base 122 of the bottle. The mounting foot 120, serving a structural tab, is dimensioned to be received. (FIG. 1C) by a corresponding track or slot 124 formed along the floor 126 of a refill tank 130 having a large internal storage volume. Material edges along the floor 126 of the refill tank 130 define the slot 124 and serve as a support structure for mounting foot 120 of the docked spray bottle 102. The larger refill tank 130, serving as a refill station for the spray bottle 102, may be shelf-mounted or placed near wherever use of the spray bottle 102 is expected, permitting convenient use and refilling of the smaller spray bottle 102. In this sense, the spray bottle 102 may be considered a satellite of the refill tank 130. The weight of the spray bottle 102, in any state of fill or depletion, is readily supported by the engagement of the mounting foot 120 with the slot 124.

The mounting foot 120 includes an internal channel in fluid connection with the internal reservoir space of the container housing 104 for refilling of the housing 104 through the foot 120 when the spray bottle 102 is docked with the refill tank 130 as shown in FIG. 1C. The mounting foot 120 has a valved inlet port 132 in fluid connection with the internal channel. The refill tank 130 has a valved outlet port 134 positioned in the slot 124 in fluid connection with internal storage volume. Upon docking of the spray bottle 102 with the refill tank 130 by insertion of the mounting foot 120 into the slot 124, the valved inlet port 132 and the valved outlet port 134 are automatically mated and a fluid connection engagement is established through which the internal reservoir space of the spray bottle 102 is filled by liquid contents flowing downwardly from the internal storage volume of the refill tank 130, through the engaged ports 134 and 132, horizontally along the internal channel of the mounting foot 120, and upwardly into the spray bottle 102. The valved inlet port 132 and the valved outlet port 134 automatically make a sealed engagement through which liquid can flow without leaking to the outside and without entraining air that may cause bubbling and restriction of flow.

The refill tank 130 may be refilled through an upper opening 136 upon removal of a cap 140. The upper opening 136 is formed and the cap 140 is placed within a recess 142 formed in the upper wall 144 of the refill tank 130, advantageously effectively countersinking the opening and cap flush with or below the upper wall to minimize overall height of the refill tank while maximizing storage volume. The refill tank 130 furthermore advantageously has a rectangular footprint, as defined by the rectangular floor 126 surrounded but upstanding planar walls 150. This particular form factor, as illustrated, permits placement of the refill tank 130 upon a shelf, for example between closely vertically spaced shelves, with high-space use efficiency.

Advantageously, the mounting foot 120 of the spray bottle 102 and the corresponding slot 124 of the refill tank 130 are horizontal, permitting side-by-side docking through a horizontal approach and departure of the spray bottle 102 when mounting for refilling and subsequent dismounting for use is wanted. This particular form factor, as illustrated, further permits mounting and refilling of the spray bottle 102 while the refill tank 130 sits, for example, upon a shelf or other structure in a crowded storage or work space. Also, the mounting foot 120 is dimensioned to displace a minimum of the volume capacity of the refill tank 130 without displacing any volume capacity of the spray bottle 102. Furthermore, by placing the mounting foot 120 at the base 122 of the bottle 102, the side docking approach provides a secure stance for the refill tank 130 without the smaller spray bottle 102 potentially tilting back from the tank 130 when sliding it in place for docking. This is due to the fact that horizontal force manually applied by a user docking the bottle will be applied above the docking slot 124. In the illustrated embodiment, the container housing 104 of the spray bottle 102 has a columnar form accommodated by a front recess of the refill tank.

Figure 2A:
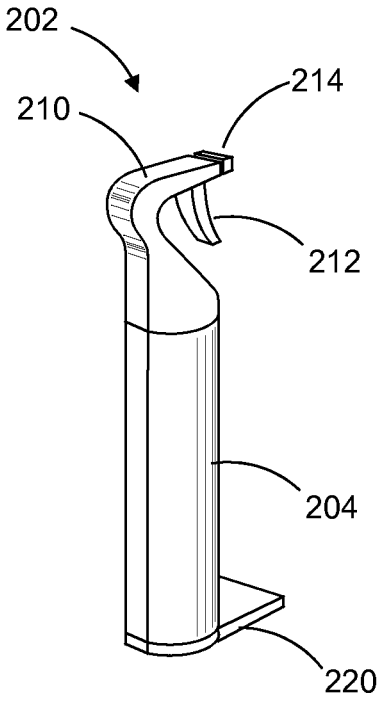
FIGS. 2A, 2B, and 2C are perspective views of a bottle and refill station according to one embodiment disclosed herein.
Figure 2B:
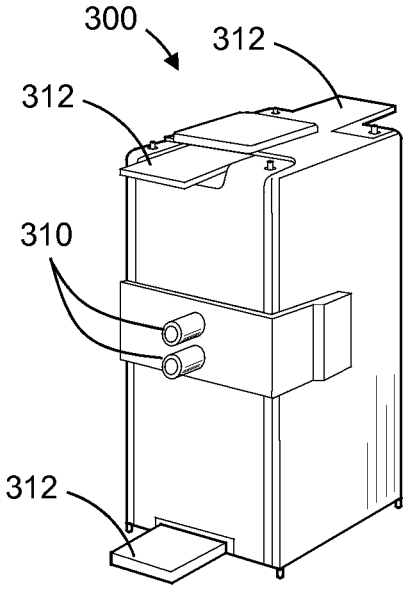
Figure 2C:
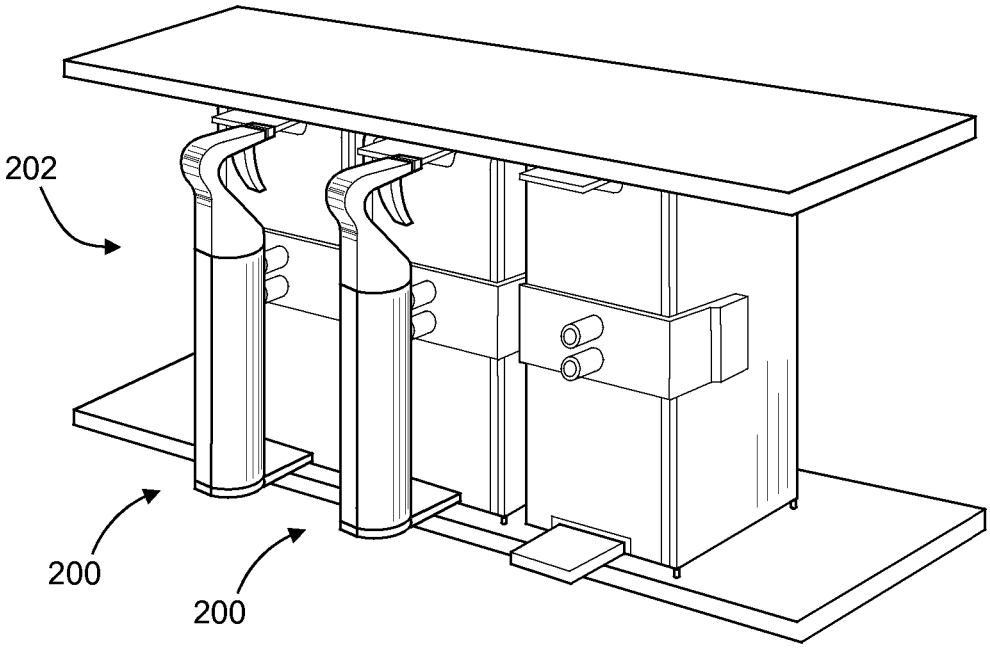

Elements of a spray bottle use and refill satellite system 200 according to at least one other embodiment is illustrated in FIGS. 2A-2C. A spray bottle 202 includes a container housing 204 that defines an internal reservoir space, and a spray head 210 mounted to the top of the housing 204. The spray head 210 includes an operable trigger 212 that actuates an internal pumping mechanism which draws liquid from the container housing 204 through an internal tube 208 (FIG. 3F) and causes dispensation of the drawn liquid through a nozzle 214 of the hand-held spray head. The container housing 204 in at least one embodiment can be refilled by removing the hand-held spray head 210 from the housing 204. The hand-held spray head 210 may be mounted to the housing 204, for example, by a snap closure, threaded collar, or other releasable sealing structure.

The spray bottle 202 of FIGS. 2A and 2C has a mounting foot 220 illustrated as projecting forward from the base 222 of the bottle. The mounting foot 220, serves as a structural support when the spray bottle is docked for refilling (FIG. 2C). The container housing 204 has a forward facing refill inlet valve 224 (FIG. 3F) for refilling of the bottle.

Figure 3A:
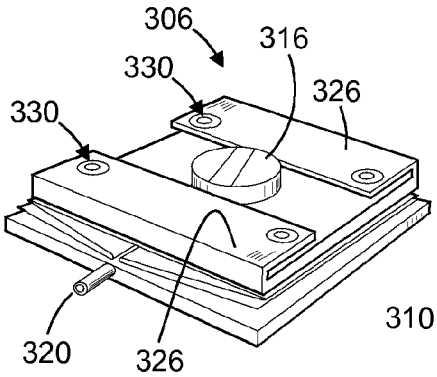
FIGS. 3A, 3B, 3C, 3D, 3E, and 3F are perspective views of a bottle and refill station according to one embodiment disclosed herein
Figure 3E:
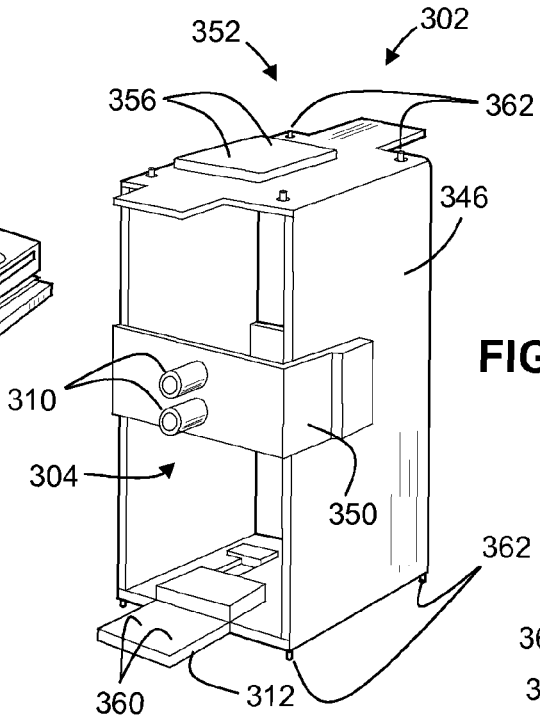
Figure 3B:
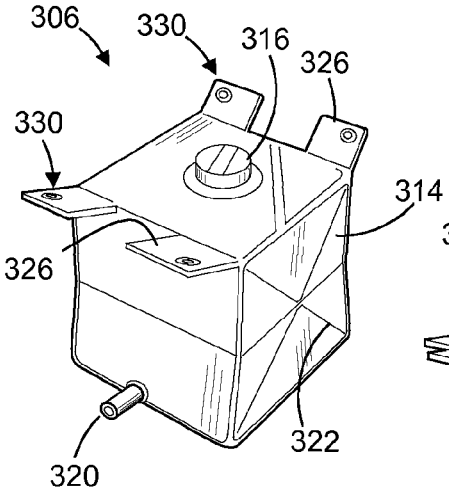

The spray bottle use and refill satellite system 200 includes an invertible dual refill station 300 (FIGS. 2B-2C, 3E), for use, for example, in refilling the spray bottle 202 (FIG. 2A) as shown in FIG. 2B. The refill station 300 includes a housing 302 defining an interior space 304 (FIG. 3E) for receiving a pair of cartons 306 (FIGS. 2B, 3B), each serving as a refill tank, in stacked and inverted relation to each other (FIG. 2B, 3F). The housing 302 includes a pair of conduit fixtures 310, one vertically arranged over the other, corresponding to the pair of refill cartons 306. The housing 302 is descriptively similar upon vertical inversion by rotation about a horizontal axis. Upper and lower terminal ledges 312 extend forward horizontally from the refill station 300 from the upper and lower margins of the station. The lower ledge 312, serving as a support structure, supports the spray bottle 202 when docked. The upper ledge 312 engages the spray head 210 and stabilizes the docked bottle. Upon inversion of the refill station 300, the upper and lower ledges 312 exchange their roles, as do the upper and lower conduit fixtures 310. The conduit fixtures 310 are arranged one over the other. The upper conduit fixture 310, in either invertible orientation, is spaced from the lower ledge 312 to dock with the refill valve 224 of the bottle 202 when docked as best illustrated in FIG. 3F.

The housing 302 maintains a pair of refill cartons 306 (FIGS. 2B, 3B) in vertically stacked and inverted relation to each other (FIG. 2B, 3F). Each carton 306 can assume a reduced configuration (FIG. 3A) and an expanded configuration (FIG. 3B). The reduced configuration may be assumed prior to and after filling and use of the carton, and during shipping and storage of the carton. The carton 306 may be provided in the reduced configuration containing a soluble product within the interior volume in a concentrated form. The soluble product may be prescribed for use in a diluted form by addition of a solvent to approximately fill the interior volume in the expanded configuration. Indicia such as product information may be provided on the outside of the carton. The carton 306 includes liquid impermeable walls 314 so as to form a watertight enclosure accessible through a top-side refill cap 316 for entry and a front lower valved spout 320, serving as a discharge outlet for exit of liquid to fill the spray bottle 202. The walls 314 are connected together by flexure zones 322 such as creases that flex or fold to facilitate transition between the reduced and expanded configurations in a predetermined fashion. In the illustrated example, the carton 306 collapses vertically to an essentially flat reduced configuration having a rectangular or square foot print.

The walls 314 can be constructed of recycled materials, such as plastic or thick paperboard coated with plastic such as polyethylene, sufficiently rigid to provide a self-standing vessel and sufficiently flexible and durable to permit transitions, optionally multiple repeated transitions, between the volumetrically reduced configuration (FIG. 3A) and volumetrically expanded configuration (FIG. 3B). Monolayer or polylayer films and sheets may be used to construct the wall. Flexible strips 326 extend forward from the top four corners of the carton 306 and have holes 330, which may be bounded by grommets for durability. The holes 330 are used to secure the carton 306 in a retained position in the interior space 304 (FIG. 3E) of the housing 302.

Figure 3C:
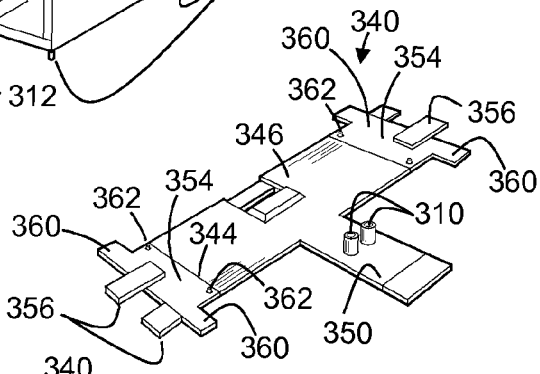
Figure 3D:
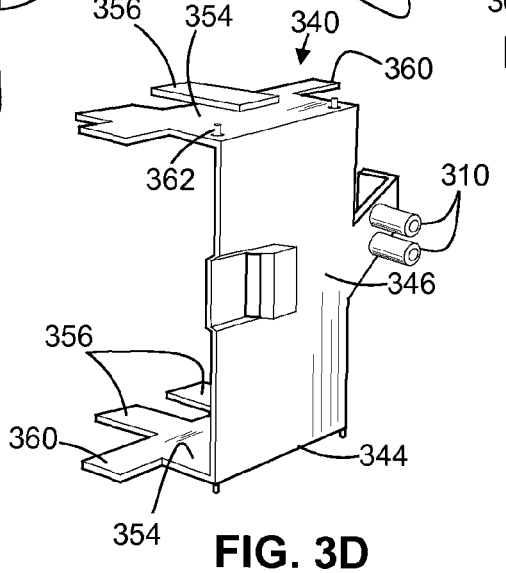
Figure 3F:
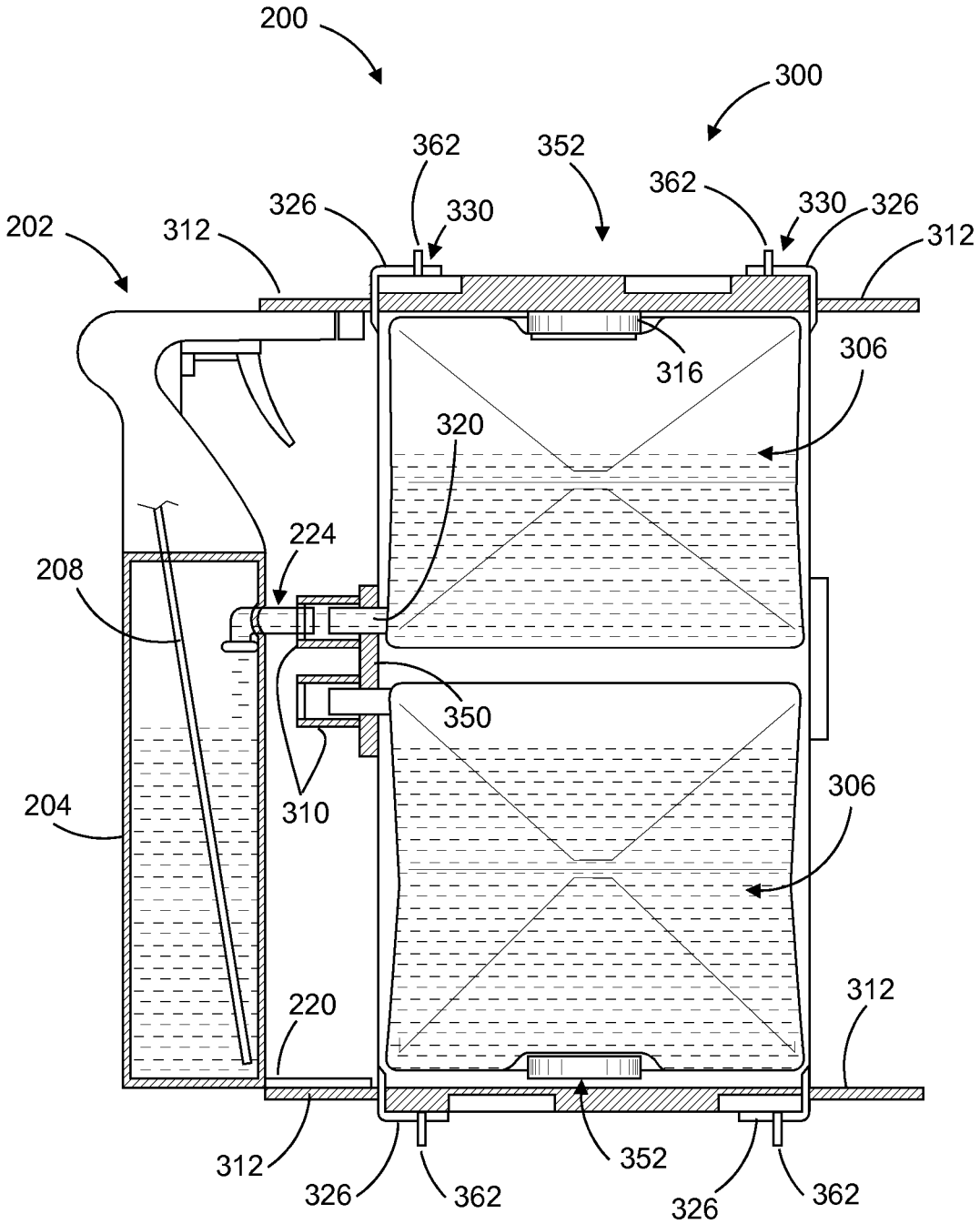

Each housing 302 may be constructed from two essentially identical blanks 340 (FIGS. 3C-3D). By twice using essentially the same blanks 340 in an asymmetric final arrangement (FIG. 3E), manufacturing costs for the housing 302 are advantageously minimized. Each blank 340 may be die-cut or molded to form a one-piece structure of plastic such as polypropylene or polyethylene. A corrugated formation may be used for rigidity and low material waste. Recycled materials such as plastic and cardboard may be used to minimize cost and environmental impact.

The blank 340 includes planar wall portions connected together by flexure zones such as living hinges 344 that flex or fold to facilitate transition between flat (FIG. 3C) and erected (FIG. 3D) configurations in a predetermined fashion for assembly. The blank 340 includes a rectangular panel 346 having longitudinal major sides and transverse minor ends. The panel 346 defines a sidewall of the assembled housing 302 with the major side defining the standing height of the housing and the minor ends defining the shelf depth of the housing. A transverse rectangular strap 350 extends centrally from a longitudinal major side of the panel 346 to define a top-heavy T shape in the flat configuration (FIG. 3C). The strap 350 forms a front or rear wall portion in the assembled configuration (FIG. 3E). When the housing 302 is loaded with cartons 306 (FIGS. 2B-2C), two panels 346, one from each of two blanks 340, define sidewalls trapping the cartons from lateral escape; and two strap 350, one from each of the two blanks 340, define front and rear wall portions trapping the cartons from forward and rear escape. In the illustrated embodiment, two straps 350 wrap partially around the assembled housing 302 in the same circumferential direction, engaging the sidewalls 346, the two blanks 340 like two dancers, each having an arm embracing the back of the other.

Lower and upper wall portions 352 (FIG. 3E) of the housing 302, serving effectively as floor and ceiling barriers interchangeably exchanging their roles upon inversion of the refill station 300, are formed upon assembly of the two blanks 340 from a pair of rectangular flaps 354, each of which extends longitudinally from a respective transverse minor end of the rectangular panel 346. First tabs 356 extend longitudinally from the flaps 354 of each blank 340 to engage the first tabs 356 and/or flap 354 of another blank 340 in interleaved fashion in the assembled configuration (FIG. 3E). Two flaps 354, one from each of the two blanks 340, abut longitudinally or overlap to form the lower and upper wall portions of the housing 302 trapping cartons 306 from vertical escape.

Each upper and lower terminal ledge 312 that extends horizontally from the refill station 300 to support the spray bottle 202 or engage the spray head 210 is formed upon assembly of the two blanks 340 from a pair of rectangular tabs 360 (FIG. 3C). The paired tabs 360 extend laterally in the same direction from longitudinally opposite rectangular flaps 354. Thus, like the flaps 354, which serve as floor and ceiling barriers, the upper and lower terminal ledges 312 interchangeably exchange their roles upon inversion of the refill station 300 (FIG. 3E).

Each blank further includes pins 362 (FIG. 3C, 3D) that extend from the rectangular flaps 354 to form vertically upward and downward upon formation of the housing 302 (FIG. 3E). In the illustrated embodiment of the blank 340, a pin 362 rises perpendicularly from the essentially planar blank 340 from the flaps 354 adjacent each corner of the rectangular panel 346. Thus upon assembly of two blanks to form the housing 302 (FIG. 3E), with the flaps 354 forming lower and upper wall portions 352 serving effectively as floor and ceiling barriers, the upper wall portion of the housing 302 has four pins 362 extending upwardly, one at each of four corners, and the lower wall portion of the housing 302 has four pins 362 extending downwardly, one at each of four corners. The pins 362 are received by the holes 330 in the flexible strips 326 (FIG. 3B) extending from the top four corners of the carton 306 to secure (FIG. 3F) each carton 306 in a retained position in the interior space 304 (FIG. 3E) of the housing 302 upon loading of the housing with cartons. In the assembly of FIG. 3F, the weight of the upper carton 306 may be at least partially or entirely supported by the flexible strips 326 engaged through the holes 330 by the upper extending pins 362. The downward extending pins 362 at the bottom of the carton-loaded invertible dual refill station 300 may serve as legs on which the station 300 stands upon a shelf or other surface. The pins 362 may also serve to register the positions of stations 300 relative to a mounting surface having corresponding hole or to maintain the relative positions of stacked stations through pin-hole registration.

Each blank 340 further includes a pair of conduit fixtures 310 (FIG. 3C, 3D) that extend from the strap 350 perpendicularly in the essentially planar form of the blank 340. In the embodiment of the blank 340 formed by molding, the pins 362 and conduit fixtures 310 are formed with the planar portions of the blank 340. Upon assembly of two blanks to form the housing 302 (FIG. 3E), the conduit fixtures 310 extend horizontally to permit a horizontal approach of the spray bottle 202 when docking. The cartons 306, as shown in FIG. 3F, are stacked (FIG. 2B, 3F) in the carton-loaded station 300, with their front lower valved spouts 320 docked with the conduit fixtures 310, which extend forward horizontally in close proximity to each other due to the inverted relation of the cartons. In a sense, the lower carton 360 is upside down, while the upper carton is properly oriented for dispensation of liquid contents to refill a docked spray bottle 202. The refill valve 224 of the bottle 202 docks (FIG. 3F) with the upper conduit fixture 310 and the spray bottle is refilled by the upper carton 306. By placement of the valved spout 320 along the lower margin of the front face of the carton 306, liquid connection to even dwindling liquid contents of the upper carton is assured. By placement of the greater portion of the container housing 204 below the refill valve 224 of the spray bottle, liquid within the upper carton 306 tends to flow by gravity into the spray bottle through the horizontally aligned valved spout 320 (of the upper carton 306), upper conduit fixture 310 (of the housing 302), and refill valve 224 (of the docked bottle 202).

Refilling of the spray bottle 202 thus occurs by docking of the refill valve 224 of the bottle 202 with the upper carton 306 loaded in the housing 302, in either invertible orientation of the station 300. In at least one example, the upper and lower cartons 306 are filled with the same type of liquid, and upon depletion of the upper carton, the station is inverted to permit further filling of the spray bottle 302 from the other carton. In another example, the upper and lower cartons are filled with different liquids, such that either liquid may be selected by a user by orienting the station 300 with the selected liquid in the upper carton 306. The cartons 306 can contain, listed here as non-limiting examples, a glass cleaner, a neutral cleaner, a disinfectant, a degreaser, and a foaming cleaner. The spray bottle in at least one example is designed so that minimal or no residue remains in its draw tube and dispensation lines to prevent cross contamination of different chemicals. In at least on example, multiple invertible dual refill stations 300 (FIG. 2C) are arranged side-by-side along a shelf or other support structure. Such an arrangement can facilitate: multiple simultaneous fillings of multiple spray bottles; partial fillings of a single spray bottle of different chemicals, one chemical from each of two or more stations 300; many refills of one or more spray bottles before inversion of a station 300 is required for further refilling of the spray bottle.

Advantageously, the refill valve 224 of the spray bottle 202 and the conduit fixture 310 extend horizontally and are docked by approach along a single horizontal direction. The mounting foot 220 of the spray bottle 202 and the terminal ledges 312 of the housing 302 extend and engage horizontally as well. These particular form factors advantageously permit mounting and refilling of the spray bottle 202 while the station 300 sits, for example, upon a shelf or other structure in a crowded storage or work space. Side-by-side docking through a horizontal approach and dismounting through a horizontal departure of the spray bottle 202 represent convenient advantages according to embodiments described herein.

While the embodiments have been described in connection with the preferred embodiments of the various figures, it is to be understood that other similar embodiments may be used or modifications and additions may be made to the described embodiments for performing the same function without deviating therefrom. Therefore, the disclosed embodiments should not be limited to any single embodiment, but rather should be construed in breadth and scope in accordance with the appended claims

What is claimed is:

1. A system comprising:

a spray bottle including a container housing that defines an internal reservoir space, a spray head connected to an upper margin of the container housing, a mounting structure connected to the container housing, and a refill inlet in fluid connection with the internal reservoir space; and a refill station having a support structure for supporting the mounting structure of the spray bottle, and a discharge outlet for refilling the internal reservoir space of the spray bottle, wherein the refill inlet of the spray bottle and the discharge outlet of the refill station are docked establishing a fluid connection upon engagement of the mounting structure of the spray bottle with the support structure of the refill station, wherein the mounting structure of the spray bottle comprises a mounting foot extending horizontally from a lower margin of the container housing, and wherein the refill station comprises a pair of cartons in vertically stacked and inverted relation to each other.

2. A system according to claim 1, wherein:

the refill station comprises a pair of conduit fixtures, one vertically arranged over the other;

each carton comprises a spout;

the spout of an upper one attic pair of cartons is docked with an upper one of the conduit fixtures; and the spout of the lower one of the pair of cartons is docked with a lower one of the conduit fixtures.

3. A system according to claim 2, wherein the refill inlet of the spray bottle is docked with the upper conduit fixture, which defines said discharge outlet, upon engagement of the mounting structure of the spray bottle with the support structure of the refill station.

4. A system according to claim 3, wherein the support structure of the refill station comprises a terminal ledge that extends horizontally from a lower margin of the refill station.

5. A system comprising:

a spray bottle including a container housing that defines an internal reservoir space, a spray head connected to an upper margin of the container housing, a mounting structure connected to the container housing, and a refill inlet in fluid connection with the internal reservoir space; and a vertically invertible refill station having at least one support structure for supporting the mounting structure of the spray bottle, and at least a first conduit fixture and a second conduit fixture for refilling of the spray bottle, wherein:

in a first orientation of the refill station, the refill inlet of the spray bottle and the first conduit fixture of the refill station are docked establishing a fluid connection upon engagement of the mounting structure of the spray bottle with at least one support structure of the refill station; and in a second orientation of the refill station vertically inverted relative to the first orientation, the refill inlet of the spray bottle and the second conduit fixture of the refill station are docked establishing a fluid connection upon engagement of the mounting structure of the spray bottle with at least one support structure of the refill station.

6. A system according to claim 5, wherein, in both the first and second orientation of the refill station, the spray bottle is dockable to the refill station through a horizontal approach and is dismountable from the refill station through a horizontal departure.

7. A system according to claim 5, wherein the refill station comprises:

a housing defining an interior space; and at least a first carton and a second carton placed in the interior space in vertically stacked and inverted relation to each other.

8. A system according to claim 7, wherein in both the first and second orientation of the refill station, a fluid connection between the refill inlet of the spray bottle and the upper one of the first and second cartons is established upon engagement of the mounting structure attic spray bottle with at least one support structure of the refill station.

9. A system according to claim 7, wherein:

the first and second conduit fixtures are attached to the housing;

the first carton comprises a spout connected to the first conduit fixture; and the second carton comprises a spout connected to the second conduit fixture.

10. A system according to claim 9, wherein the first and second conduit fixtures are vertically arranged one over the other.

11. A system according to claim 7, wherein each carton comprises at least one flexible rectangular flap having at least one hole that receives a pin that extends from the housing.

12. A system according to claim 7, wherein the housing comprises two essentially identical blanks, each including planar wall portions connected together by flexure zones.

13. A system according to claim 12, wherein:

each blank comprises a rectangular panel and a strap extending from the rectangular panel;

two straps wrap at least partially around the housing in the same circumferential direction; and the strap of each blank engages the rectangular panel of the other blank.

14. A system according to claim 5, wherein a lower terminal ledge and an upper terminal ledge extend horizontally from the refill station to, respectively, support the spray bottle from below and engage the spray head from above.

* * * * *